US010839722B2

(12) United States Patent
Wang

(10) Patent No.: US 10,839,722 B2
(45) Date of Patent: Nov. 17, 2020

(54) FLEXIBLE DISPLAY DEVICE

(71) Applicant: Wuhan China Star Optoelectronics Semiconductor Display Technology Co., Ltd., Hubei (CN)

(72) Inventor: Lei Wang, Hubei (CN)

(73) Assignee: WUHAN CHINA STAR OPTOELECTRONICS SEMICONDUCTOR DISPLAY TECHNOLOGY CO., LTD., Wuhan (CN)

( * ) Notice: Subject to any disclaimer, the term of this patent is extended or adjusted under 35 U.S.C. 154(b) by 455 days.

(21) Appl. No.: 15/748,527

(22) PCT Filed: Dec. 28, 2017

(86) PCT No.: PCT/CN2017/119553
§ 371 (c)(1),
(2) Date: Jan. 29, 2018

(87) PCT Pub. No.: WO2019/029111
PCT Pub. Date: Feb. 14, 2019

(65) Prior Publication Data

US 2020/0126457 A1 Apr. 23, 2020

(30) Foreign Application Priority Data

Aug. 8, 2017 (CN) ..... 2017 1 0670912

(51) Int. Cl.
*G09F 9/30* (2006.01)

(52) U.S. Cl.
CPC ..... *G09F 9/301* (2013.01)

(58) Field of Classification Search
CPC .... G06F 1/1652; G06F 1/1616; G06F 1/1681; G06F 1/16; G06F 1/1641; G06F 1/1677;
(Continued)

(56) References Cited

U.S. PATENT DOCUMENTS

2007/0241002 A1* 10/2007 Wu ..... G06F 1/1601 206/150
2013/0201208 A1* 8/2013 Cho ..... G06F 3/0488 345/619

(Continued)

FOREIGN PATENT DOCUMENTS

CN 203773882 8/2014
CN 106448465 2/2017

*Primary Examiner* — Mandeep S Buttar
(74) *Attorney, Agent, or Firm* — Hemisphere Law, PLLC; Zhigang Ma

(57) ABSTRACT

The present invention discloses a flexible display device including a display device main body; a flexible display panel curling arranged inside the display device main body and capable of being pulled out from the display device main body; wherein the display main body is provided with a limiting component for controlling to pull out the flexible display panel to a required length with respect to the display device main body and to curl the flexible display panel to be returned to the display device main body; and the flexible display panel is pulled out and extended to the required length from an opening of the display device main body and is retaining fixation by the limiting component to make the arrangement of the limiting component more reasonable and to control the flexible display panel to perform reginal display on the pulled up and extended area.

6 Claims, 1 Drawing Sheet

(58) Field of Classification Search
CPC ..... G06F 1/1618; G09F 9/301; G09F 9/3026; G09F 9/33; G09F 9/37; H01L 2251/5338; H05K 5/0017; H05K 1/028; H05K 2201/10128; G09G 2380/02
USPC ..... 361/679.01, 679.21, 679.27; 345/204
See application file for complete search history.

(56) References Cited

U.S. PATENT DOCUMENTS

| | | | | |
|---|---|---|---|---|
| 2013/0234951 | A1* | 9/2013 | Kim | G06F 1/1652 345/173 |
| 2015/0340004 | A1* | 11/2015 | Pang | G06F 1/1652 345/205 |
| 2016/0187929 | A1* | 6/2016 | Kim | G06F 1/1601 345/184 |
| 2016/0374228 | A1* | 12/2016 | Park | H05K 7/16 |
| 2017/0023978 | A1* | 1/2017 | Cho | H04M 1/0268 |
| 2017/0103735 | A1* | 4/2017 | Oh | G09G 5/006 |

* cited by examiner

FLEXIBLE DISPLAY DEVICE

RELATED APPLICATIONS

The present application is a National Phase of International Application Number PCT/CN2017/119553, filed Dec. 28, 2017, and claims the priority of China Application No. 201710670912.3, filed Aug. 8, 2017.

FIELD OF THE DISCLOSURE

The disclosure relates to a display panel manufacturing field, and more particularly to a flexible display device.

BACKGROUND

With advances of the display technology, the future flexible display panel may take a more space-saving approach, for example, the use of curly placed way, the panel is curled in the container when not in use, and the flexible panel can be pulled out during used. The existing display device composed of a central shaft, a flexible panel and a curl driving mechanism has the following technical defects due to unreasonable structural design:

1: the display panel needs to perform full-panel display for each time, and is not conducive to save energy;

2: the setting of the limiting component is cumbersome and with single function, is not conducive to save space and cost control.

SUMMARY

The technical problem to be solved by the present invention is to provide a flexible display device that makes the arrangement of the limiting component becoming more reasonable, and is compatible with the control unit to control the flexible display panel to perform reginal display in the area where it is pulled out; the structure is simplify, and is benefit from cost control and improves assembly efficiency.

In order to solve the above technical problem, the embodiments of the present invention provide a flexible display device, including a display device main body; a flexible display panel curling arranged inside the display device main body and capable of being pulled out from the display device main body; wherein the display main body is provided with a limiting component for controlling to pull out the flexible display panel to a required length with respect to the display device main body and to curl the flexible display panel to be returned to the display device main body; and the flexible display panel is pulled out and extended to the required length from an opening of the display device main body and is retaining fixation by the limiting component.

Wherein a rotation shaft is disposed inside the display device main body for curling the flexible display panel, a reset component is provided inside the rotation shaft for resetting the rotation shaft and in conjunction with the flexible display panel to be returned to an initial curled state.

Wherein the reset component includes a gear disposed on the rotation shaft, a limiting pin matched with the gear and disposed at the opening of the display device main body, wherein the limiting pin is latched into the rotating gear and performing fixation to the rotation shaft.

Wherein two opposite ends of the rotation shaft are respectively provided with calipers for detecting a pulled out and extended length of the flexible display panel with respect to the display device main body.

Wherein a detecting component is provided on the rotation shaft for detecting a number of rotations of the rotation shaft and a rotation offset angle.

Wherein, further including a control unit for obtaining a pulled out and extended area of the flexible display panel with respect to the display device main body according to the detected pulled out and extended length with respect to the display device main body and the data of the number of rotations of the rotation shaft and the rotation offset angle of the flexible display panel.

Wherein the control unit controls the flexible display panel to perform a reginal display in the area of the flexible display panel pulled out and extended with respect to the display device main body.

Wherein a limit button is provided outside of the display device main body and in conjunction with the limiting pin.

Wherein the reset component is a rotating spring.

In order to solve the above technical problem, the embodiments of the present invention provide a flexible display device, including a display device main body; a flexible display panel curling arranged inside the display device main body and capable of being pulled out from the display device main body; wherein the display main body is provided with a limiting component for controlling to pull out the flexible display panel to a required length with respect to the display device main body and to curl the flexible display panel to be returned to the display device main body; the flexible display panel is pulled out and extended to the required length from an opening of the display device main body and is retaining fixation by the limiting component; a rotation shaft is disposed inside the display device main body for curling the flexible display panel, a reset component is provided inside the rotation shaft for resetting the rotation shaft and in conjunction with the flexible display panel to be returned to an initial curled state; and a detecting component is provided on the rotation shaft for detecting a number of rotations of the rotation shaft and a rotation offset angle.

Wherein the reset component includes a gear disposed on the rotation shaft, a limiting pin matched with the gear and disposed at the opening of the display device main body, wherein the limiting pin is latched into the rotating gear and performing fixation to the rotation shaft.

Wherein two opposite ends of the rotation shaft are respectively provided with calipers for detecting a pulled out and extended length of the flexible display panel with respect to the display device main body.

Wherein, further including a control unit for obtaining a pulled out and extended area of the flexible display panel with respect to the display device main body according to the detected pulled out and extended length with respect to the display device main body and the data of the number of rotations of the rotation shaft and the rotation offset angle of the flexible display panel.

Wherein the control unit controls the flexible display panel to perform a reginal display in the area of the flexible display panel pulled out and extended with respect to the display device main body.

Wherein a limit button is provided outside of the display device main body and in conjunction with the limiting pin.

Wherein the reset component is a rotating spring.

The implementation of the flexible display device provided by the present invention has the following beneficial effects:

First, the display device main body is provided with the limiting component for controlling the extension of the flexible display panel to the required length with respect to the display device main body and the curling the flexible display panel to return into the display device main body; the flexible display panel is pulled out and extended to the required length and locked and fixed by a limiting component from the opening of the display device main body, the design of the limiting component is simplify and conducive to saving space and cost control.

Second, a control unit is also included. The control unit controls the flexible display panel to perform the reginal display in the area where the flexible display panel is extended and pulled out with respect to the display device main body, the operation is convenient, and the energy consumption is further reduced.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

The technical solutions in the embodiments of the present invention will be described clearly and completely hereinafter with reference to the accompanying drawings in the embodiments of the present invention. Apparently, the described embodiments are merely a part but not all embodiments of the present invention. All other embodiments obtained by a person of ordinary skill in the art based on the embodiments of the present invention without creative efforts shall fall within the protection scope of the present invention.

Figure 1:
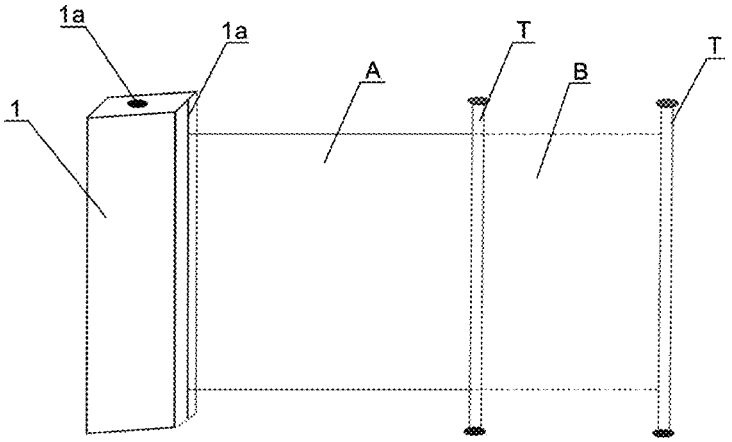
FIG. 1 is a schematic diagram of an effect of a flexible display panel of a flexible display device in a pull out the expanded state according to an embodiment of the present invention.
Figure 2:
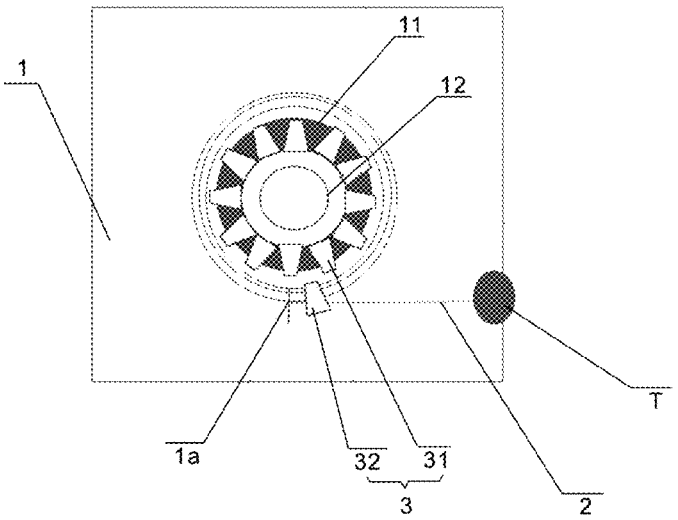
FIG. 2 is a schematic plan view of a flexible display panel of the flexible display device in a curled-up state according to an embodiment of the present invention.

Referring to FIG. 1 to FIG. 2, a first embodiment of a flexible display device according to the present invention is shown.

The flexible display device in this embodiment includes: a display device main body 1; a flexible display panel 2 curling arranged inside the display device main body and capable of being pulled out from the display device main body; wherein: the display main body 1 includes a limiting component 3 for controlling to pull out the flexible display panel 2 to a required length with respect to the display device main body 1 and controlling the flexible display panel 2 to be curled and returned to the display device main body 1; the flexible display panel 2 is pulled out and extended to the required length from an opening 1*a* of the display device main body 1 and is retaining fixation by the limiting component 3.

In a specific embodiment, the display device main body 1 functions to receive and provide protection to the flexible display panel 2. The display device main body 1 in this embodiment is a square column structure, and is provided based on the bendability characteristics of the flexible display 2, a rotation shaft 11 for curling the flexible display panel 2 is disposed in a center axis position between the opposite two ends of the display device main body 1, a reset component 12 for resetting the rotation shaft 11 and in conjunction with the flexible display panel 2 to be returned to an initial curled state is provided inside the rotation shaft 11. In this embodiment, the reset component 12 is a rotating spring in a pressed state; the rotating spring can be reset to rotate when the rotation shaft 11 is not subjected to an external force, so as to in conjunction with the flexible display panel 2 to be returned to the initial curled state.

The flexible display panel 2 has a bendability that can be entirely curled and wound around the rotation shaft 11. In this embodiment, one end of the flexible display panel 2 is fixedly connected to the rotation shaft 11, and the other opposite end is connected to a holding component T, and the holding component T is stuck on the opening 1*a* of the display device main body 1, when the flexible display 2 is fully curled on the rotation shaft 11. When the flexible display device is not in use, the flexible display panel 2 is entirely curled and wound around the rotation shaft 11. When it is in used, one end of the flexible display panel 2 at the opening 1*a* of the hand-held display device main body 1 is continuously pulled out from the display device main body 1 till a required panel display area, as shown in FIG. 1, the sum of the required panel display area A of the flexible display panel 2 pulled out from the display device main body 1 and the display area B on the surface of the dotted line portion is the maximum display area of the flexible display panel 2 can be pulled out of the display device main body 1.

Preferably, two opposite ends of the rotation shaft 11 are respectively provided with calipers for detecting the pulled out and extended length of the flexible display panel 2 with respect to the display device main body 1. The function of the calipers is to detect the pulled out and extended length of the flexible display panel 2 related to position of the opening 1*a* of the display device main body 1 and provides data support for the flexible display panel 2 that only controlling the display pulling out and extending dimensions subsequently.

Preferably, a detecting component for detecting a number of rotations of the rotation shaft 11 and a rotation offset angle is further provided on the rotation shaft 11. The function of the detecting component is to detect the number of rotations of the rotation shaft 11 and the rotation offset angle during performing processes of the pulling out and resetting of the flexible display panel 2 with respect to the opening 1*a* of the display device main body 1, and provides data support for the flexible display panel 2 that only controlling the display pulling out and extending dimensions subsequently.

Further, the fixing of the flexible display panel 2 with respect to the opening 1*a* of the display device main body 1 for performing the pulling out or resetting the curl is implemented by the limiting component 3. In this embodiment, the limiting component 3 includes gears 31 disposed at two opposite ends of the rotation shaft 11, and limiting pins 32 matched with the gears 31 are disposed at the position of the opening 1*a* of the display device main body 1. In a specific implementation, when the limiting pin 32 is latched into the rotating gear 31, the rotation shaft 11 can be fixed, so that the pulled-out display range of the flexible display panel 2 with respect to the display device main body 1 can be fixed.

At the same time, when the limiting pin 32 is pulled out from the gear 31, the rotation shaft 11 is reversed under the action of its internal rotating spring, so that in conjunction with the flexible display panel 2 to perform resetting and curling, to realize the curling and storage of flexible display panel 2 with respect to the display device main body 1.

Preferably, a limit button 4 is provided on the outside of the display device main body 1 in conjunction with the limiting pin 32. In specific implementation, the flexible display panel 2 is pulled out with respect to the display device main body 1, when the flexible display panel 2 is pulled to an area required by the user, the limiting button 4 is pressed to engage the limiting pin 32 latched into the gear 31 rotated by the rotation shaft 11. When the user is finished using, the limiting button 4 is pressed again, the limiting pin 32 is disengaged from the gear 31, under the action of the rotating spring inside the rotating shaft 11, the rotating shaft 11 is reset and in conjunction with the flexible display panel 2 to be returned to the initial curling state, and the flexible display panel 2 is re-wrapped on the rotating shaft 11.

In this embodiment, the performing of a regional display of the flexible display panel in the pulled out and extended area with respect to the display device main body is implemented by the following structure:

The flexible display device provided by the present invention further includes a control unit; the control unit is connected with the caliper and the detection unit respectively for collecting the data detected by the caliper and the detection unit. In specific implementation, the control unit obtains a pulled out and extended area of the flexible display panel 2 with respect to the display device main body 1 according to the detected pulled out and extended length and the data of the number of rotations of the rotation shaft 11 and the rotation offset angle of the flexible display panel 2 with respect to the display device main body 1. After acquiring the data of the pulled out and extended area of the flexible display panel 2 with respect to the display device main body 1, the control unit controls the flexible display panel 2 to perform reginal display in the area where the flexible display panel 2 is extended and pulled out with respect to the display device main body 1, so as to realize reginal display function.

In the specific implementation of the flexible display device provided by the present invention, the flexible display panel 2 is pulled out from the opening 1*a* of the display device main body 1, when the flexible display panel 2 is pulled to the area required by the user, the limiting button 4 is pressed, the limiting pin 32 is in conjunction with the limiting button 4 and latched into the gear 31 rotated by the rotation shaft 11, so as to achieve a relatively position fixation between the flexible display panel 2 pulled out in a of the certain size and the opening 1*a* of the display device main body 1. During this process, the control unit obtains the pulled out and extended area of the flexible display panel 2 with respect to the display device main body 1 according to the detected pulled out and extended length by the holding detection and the data of the number of rotations of the rotation shaft 11 and the rotation offset angle of the flexible display panel 2 with respect to the display device main body 1 by the detection unit. Following the control unit controls the flexible display panel 2 to perform reginal display in the area where the flexible display panel 2 is extended and pulled out with respect to the display device main body 1, so as to realize reginal display function. When the user is finished using, the limiting button 4 is pressed again, to release the limiting pin 32 from the gear 31. Under the action of the rotating spring inside the rotation shaft 11, the rotation shaft 11 is reset and in conjunction with the flexible display panel 2 to be returned to the initial curling state. The flexible display panel 2 is re-wrapped on the rotation shaft 11.

The implementation of the flexible display device provided by the present invention has the following beneficial effects:

First, the display device main body is provided with the limiting component for controlling the extension of the flexible display panel to the required length with respect to the display device main body and the curling the flexible display panel to return into the display device main body; the flexible display panel is pulled out and extended to the required length and locked and fixed by a limiting component from the opening of the display device main body, the design of the limiting component is simplify and conducive to saving space and cost control.

Second, a control unit is also included. The control unit controls the flexible display panel to perform the reginal display in the area where the flexible display panel is extended and pulled out with respect to the display device main body, the operation is convenient, and the energy consumption is further reduced.

What is claimed is:

1. A flexible display device, comprising a display device main body;

a flexible display panel curling arranged inside the display device main body and capable of being pulled out from the display device main body; wherein the display main body is provided with a limiting component for controlling to pull out the flexible display panel to a required length with respect to the display device main body and to curl the flexible display panel to be returned to the display device main body; and the flexible display panel is pulled out and extended to the required length from an opening of the display device main body and is retaining fixation by the limiting component;

wherein a rotation shaft is disposed inside the display device main body for curling the flexible display panel;

wherein the limiting component comprises gears disposed at two opposite ends of the rotation shaft, and limiting pins matched with the gears and disposed at the opening; and the limiting pins are latchable into the gears and for performing fixation to the rotation shaft;

wherein the flexible display device further comprises a control unit for collecting a detected pulled out and extended length of the flexible display panel with respect to the display device main body and a detected data of a number of rotations and a rotation offset angle of the rotation shaft, obtaining a pulled out and extended area of the flexible display panel with respect to the display device main body according to both the detected pulled out and extended length and the detected data, and controlling the flexible display panel to perform a reginal display in the pulled out and extended area of the flexible display panel.

2. The flexible display device according to claim 1, wherein a reset component is provided inside the rotation shaft for resetting the rotation shaft and in conjunction with the flexible display panel to be returned to an initial curled state.

3. The flexible display device according to claim 1, wherein a detecting component is provided on the rotation shaft for detecting the number of rotations and the rotation offset angle of the rotation shaft as the detected data.

4. The flexible display device according to claim 1, wherein a limit button is provided outside of the display device main body and in conjunction with the limiting pins.

5. The flexible display device according to claim 2, wherein the reset component is a rotating spring.

6. The flexible display device according to claim 1, wherein the limiting pins are located outside of the gears.

* * * * *